US005244513A

United States Patent [19]

Kadoya et al.

[11] Patent Number: 5,244,513

[45] Date of Patent: Sep. 14, 1993

[54] FE-CR-NI-SI SHAPE MEMORY ALLOYS WITH EXCELLENT STRESS CORROSION CRACKING RESISTANCE

[75] Inventors: Yoshikuni Kadoya; Toshio Yonezawa, both of Takasago; Naotake Ito, Kobe; Toru Inazumi, Tokyo; Yutaka Moriya, Tokyo; Haruo Suzuki, Tokyo; Katsumi Masamura, Tokyo; Takemi Yamada, Tokyo, all of Japan

[73] Assignees: Mitsubishi Jukogyo Kabushiki Kaisha; NKK Corporation, both of Tokyo, Japan

[21] Appl. No.: 858,553

[22] Filed: Mar. 27, 1992

[30] Foreign Application Priority Data

Mar. 29, 1991 [JP] Japan ..... 3-89206
Feb. 28, 1992 [JP] Japan ..... 4-078502

[51] Int. Cl.[5] ..... C22C 38/46; C22C 38/48; C22C 38/50

[52] U.S. Cl. ..... 148/402; 420/50; 420/51

[58] Field of Search ..... 148/402, 563; 420/50, 420/51

[56] References Cited

FOREIGN PATENT DOCUMENTS 0336175 10/1989 European Pat. Off. .
59-70751 4/1984 Japan ..... 148/402
62-112720 5/1987 Japan ..... 148/563
2-077554 3/1990 Japan .
2-301514 12/1990 Japan .

OTHER PUBLICATIONS

C. W. Wegst, "Stahlschlussel, 15, Auglage". Verlan Stahlschlussel Wegst GmbH, Title page and pp. 329, 336, 372, and 408 (1989).
H. Funakubo (editor), "Shape Memory Alloys", Sangyo Tosho, Jun. 7, 1984 'Applications of Shape Memory Alloys' by U. Suzuki, pp. 113–114 and 8 (Table 1).
B. E. Wilde, "Corrosion", National Association of Corrosion Engineers (NACE).
Disclosure Bulletin, vol. 42, No. 11, Nov. 1986, pp. 678–681.
Patent Abstract of Japan, 125 C 726, Jun. 8, 1990 (corres above JP,A554).
Patent Abstract of Japn, 146 C 809, Feb. 21, 1991 (corres above JP,A 514).

*Primary Examiner*—Deborah Yee
*Attorney, Agent, or Firm*—Frishauf, Holtz, Goodman & Woodward

[57] ABSTRACT

Ferrous group shape memory alloys consisting essentially of Cr: 16.0–21.0 wt %, Si: 3.0–7.0 wt % and Ni: 11.0–21.0 wt % and satisfying Ni wt % $\geqq [0.67\times\{Cr+1.2\times(Si+Ti+Zr+Hf+V+Nb+Ta)\}-]$ wt % and (Cr+Si) wt % $\geqq$ 20 wt %, these ferrous-group shape-memory alloys having a corrosion resistance, a shape-memorizing properties, an intergranular corrosion resistance and a stress corrosion cracking resistance in nitric acid for nuclear fuel reprocessing plants and high-temperature, high-pressure water for light-water reactors.

25 Claims, 8 Drawing Sheets

FE-CR-NI-SI SHAPE MEMORY ALLOYS WITH EXCELLENT STRESS CORROSION CRACKING RESISTANCE

BACKGROUND OF THE INVENTION

1. Field of the Invention

This invention concerns Fe-Cr-Ni-Si shape memory alloys with excellent stress corrosion cracking resistance, and in particular, relates to the Fe-Cr-Ni-Si shape memory alloys with excellent stress corrosion cracking resistance, having good shape-memorizing properties, corrosion resistance and intergranular corrosion resistance in high-temperature, high-pressure water for the nuclear power field or in nitric acid for nuclear fuel reprocessing plants.

2. Description of the Prior Art

A ferrous-group shape memory alloy features the property of being restored to its shape prior to plastic deformation when the alloy is subjected to plastic deformation at a specified temperature close to the martensite transformation temperature and then the alloy is heated to a specific temperature over the inverse transformation temperature to its base phase.

By giving plastic deformation to this shape memory alloy at a specified temperature, the crystalline structure is transformed from its base phase into martensite.

As described above, when an alloy which is subjected to plastic deformation is heated to a specified temperature over the inverse transformation temperature to its base phase, martensite is inversely transformed to its original base phase: the alloy shows shape-memorizing properties, by which the said alloy is restored to its original shape prior to undergoing plastic deformation. Many non-ferrous shape-memory alloys are already known as having these shape-memorizing properties. (For example, "Shape Memory Alloys" edited by Hiroyasu Funakubo, Sangyo Tosho 1984)

Among these conventional non-ferrous shape memory alloys, Ni-Ti and Cu shape memory alloys are already being put to practical use. Tube joints, clothing, medical instruments and actuators are manufactured by employing these non-ferrous shape memory alloys. In recent years, technological development has progressed to a point where these shape memory alloys are now applied to a variety of industrial uses.

However, from the viewpoint of application to structural members, remarkable hydride formation occurs when Ni-Ti shape memory alloys are used in high-temperature water. Accordingly, they have been unsuitable for such an environment. Cu-Zn-Al shape memory alloys have insufficient corrosion resistance. Moreover, these non-ferrous shape memory alloys are expensive, and from an economical viewpoint, their use is limited.

Under such circumstances, ferrous-group shape memory alloys which are less expensive than non-ferrous shape memory alloys are being developed. A more extensive scope of application is envisaged for the ferrous-group shape memory alloys as opposed to the non-ferrous shape memory alloys which are restricted in use due to their prohibitive cost. The martensite to which a ferrous-group shape memory alloy is transformed from its base phase by undergoing plastic deformation can be roughly divided into fct (face-centered tetragonal structure), bct (body-centered cubic structure) and hcp (dense hexagonal structure) from the viewpoint of crystalline structure. Ferrous group shape memory alloys that are transformed from their base phase to $\epsilon$ martensite of dense hexagonal structure by undergoing plastic deformation and that are excellent in corrosion resistance are proposed in JP, A No. 2-77554 (hereinafter referred to as "the first prior art"). That is, the alloys based on the first prior art contain Cr: 5.0–20.0 wt %, Si: 2.0–8.0 wt %, at least one element selected in the group comprising Mn: 0.1–14.8 wt %, Ni: 0.1–20.0 wt %, Co: 0.1–30.0 wt %, Cu: 0.1–0.3 wt %, N: 0.001–0.400 wt %, and have excellent shape-memorizing properties and corrosion resistance.

In JP, A No. 2-301514, alloys containing Cr: 10–17 wt %, Si: 3.0–6.0 wt %, Mn: 6.0–25.0 wt %, Ni: 7.0 wt % or less, Co: 2.0–10.0 wt % and Ti, Zr, V, Nb, Mo, Cu, etc. are proposed as high Mn shape memory alloys with a high Cr content and improved corrosion resistance (hereinafter referred to as "the second prior art").

On the other hand, B.E. WILDE, "CORROSION-NACE (1986), Vol. 42, No. 11, p. 678" can, for example, be cited as regards ferrous-group alloys with excellent stress corrosion cracking resistance. That is, this report shows alloys with excellent stress corrosion cracking resistance in high-temperature water, containing Cr: 17.0–19.0 wt %, Si: 0.35–4.79 wt %, Ni: 8.83–9.07 wt %, Mn: 1.30–1.53 wt %, Cu: 0.009–0.20 wt %, N: 0.011–0.040 wt % and Mo: 0.019–0.21 wt % (hereinafter referred to as "the third prior art").

The shape memory alloys that are used in nitric acid for nuclear fuel reprocessing plants and in high-temperature water (primary cooling water) for light-water reactors must have excellent shape-memorizing properties, intergranular corrosion resistance and stress corrosion cracking resistance. However, of the said prior arts, none can be found that meets this requirement.

The ferrous-group shape memory alloys disclosed in the said first prior art are ferrous-group alloys to which Cr and Si elements are added to improve the shape-memorizing properties and corrosion resistance and also to which at least one element of Mn, Ni, Co and N is added. However, these alloys have the following problems. Though the shape memory alloys show excellent corrosion resistance, this corrosion resistance was evaluated at an atmospheric exposure test over a period of two years and the said intergranular corrosion resistance in nitric acid and stress corrosion cracking resistance in high-temperature water are not always sufficient. As seen in its working examples, the basic alloy types can be roughly divided into the Fe-13Cr-6Si type and the Fe-18Cr-2Si type. The alloys of the former contain an addition of 15.1 wt % or less of Cr and the alloys of the latter contain an addition of 2.8 wt % or less of Si. Accordingly, the improvement in the intergranular corrosion resistance in nitric acid and stress corrosion cracking resistance in high-temperature water envisaged as an effect of the addition of Cr and Si is inadequate.

In the first prior art, the C and N content is limited to 0.1 wt % or less. The study conducted by this inventor and others shows that when alloys with a total C and N content above 0.01 wt % undergo thermomechanical treatment indispensable to raise their shape-memorizing properties (for example, thermomechanical treatment of heating to 500°–700° C. after deformation is given at ambient temperature), the intergranular corrosion resistance in nitric acid and the stress corrosion cracking resistance in high-temperature water are deteriorated by the lack of Cr from the grain boundary due to the precipitation of Cr carbide or Cr nitride at the grain boundary or the segregation of C or N at the grain boundary even if the said precipitated phases do not exist. However, to reduce the total C and N content to 0.1 wt % or less in the alloy composition provided in the same prior art, no means, except the use of expensive raw materials and/or the use of special fusions, can be found with existing manufacturing techniques, resulting in very high cost.

Moreover, in the said first prior art, Co is added as an optional element. However, as described in the working example, the Co content is 1.0 wt % or more. Accordingly, the application to high-temperature water (primary cooling water) in the nuclear power field is unsuitable from the viewpoint of activation and the applicable scope is limited.

The ferrous-group shape memory alloys disclosed in the second prior art contain a higher Cr content with the purpose of improving corrosion resistance and the addition of Ti, Zr, V and Nb, and also high Mn content with the purpose of raising the shape-memorizing properties. This second prior art has the following problems. That is, firstly, though the Cr content is set at 10–17 wt %, the Cr content in the working example is less than 16 wt %. Accordingly, improvement in the intergranular corrosion resistance in nitric acid and the stress corrosion cracking resistance in high-temperature water expected as an effect of the addition of Cr are inadequate.

Because the Mn content is set at 6.0 wt % or more, the stress corrosion cracking resistance in high-temperature water is deteriorated by an increase of non-metal inclusions and the intergranular corrosion resistance in nitric acid is also deteriorated. Moreover, because the Co content is set at 2.0 wt % or more, the alloy is unsuitable from the viewpoint of activation for application to high-temperature water (primary cooling water) in the nuclear power field and its applicable scope is limited.

The alloys disclosed in the third prior art show excellent properties of stress corrosion cracking resistance. However, they can be roughly divided into alloys with an Si content of 2.9 wt % or less and alloys with an Si content of 3.8 wt % or more. Regarding the former, the intergranular corrosion resistance and stress corrosion cracking resistance in the said environment are inadequate because the Si content is 2.9 wt % or less. Regarding the latter, the shape memorizing property is inadequate because the ratio of the total content of austenite-forming elements to the total content of ferrite-forming elements is not appropriate.

For these reasons, the development of ferrous-group shape memory alloys with excellent shape-memorizing properties, intergranular corrosion resistance and stress corrosion cracking resistance that permit their application to nitric acid for nuclear fuel reprocessing plants and high-temperature water (primary cooling water) for light-water reactors is strongly desired. However, such ferrous-group shape memory alloys have not yet been achieved.

SUMMARY OF THE INVENTION

Accordingly, it is an object of this invention to provide ferrous-group shape memory alloys that are free from the technical problems of the said prior arts.

A more detailed object of this invention is to provide ferrous-group shape-memory alloys that have excellent shape-memorizing properties, corrosion resistance and stress corrosion cracking resistance and that are useable in the high-temperature, high-pressure deionized water (primary cooling water), typical of the nuclear power field.

It is another object of this invention to provide ferrous-group shape memory alloys that are excellent in intergranular corrosion and stress corrosion cracking resistance and that are useable in nitric acid for nuclear fuel reprocessing plants and in high-temperature, high-pressure water (primary cooling water) for light-water reactors.

When plastic deformation is given to a ferrous-group shape-memory alloy at a specified temperature, the phase of the said alloy is transformed from its base phase of austenite to $\epsilon$ martensite. After that, when the said alloy, the base phase of which has been transformed to $\epsilon$ martensite, is heated at a temperature above the austenite transformation temperature (hereinafter referred to as the "Af point") and close to the Af point, the $\epsilon$ martensite is inversely transformed to its base phase of austenite. As a result, the said alloy that underwent plastic deformation is restored to its original shape prior to the plastic deformation.

For the ferrous-group shape-memory alloy to have excellent shape-memorizing properties, the following conditions must be satisfied.

(1) The base phase of the said alloy, prior to undergoing plastic deformation at a specified temperature, must be composed mainly of austenite. The said specified temperature means a temperature that permits transformation from the base phase to $\epsilon$ martensite when plastic deformation is given to the said alloy at this temperature.

(2) The stacking fault energy of austenite must be low. In addition, when plastic deformation is given to the said alloy, the phase of austenite must be transformed from its base phase only to $\epsilon$ martensite, and must not transformed to $\alpha'$ martensite.

(3) The yield strength of austenite must be high. In addition, when plastic deformation is given to the said alloy, slide deformation must not occur in the crystalline structure of the said alloy.

According to this invention, ferrous-group shape-memory alloys that are useable in nitric acid and high-temperature, high-pressure water and which particularly show excellent shape-memorizing properties, corrosion resistance and stress corrosion cracking resistance can be provided by ferrous-group shape-memory alloys containing Cr: 16.0–21.0 wt %, Si: 3.0–7.0 wt % and Ni: 11.0–21.0 wt %, satisfying Ni wt $\% \geqq \{0.67 (Cr+1.2\ Si)-3\}$ wt % and $(Cr+Si)$ wt $\% \geqq 20$ wt %, and having a residue of Fe and inevitable impurities.

Moreover, according to this invention, ferrous-group shape-memory alloys that are useable in nitric acid and high-temperature, high-pressure water and which particularly show excellent intergranular corrosion resistance and stress corrosion cracking resistance can be provided by ferrous-group shape memory alloys containing Cr: 16.0–21.0 wt %, Si: 3.0–7.0 wt % and Ni: 11.0–21.0 wt %, with an addition of one or more elements selected from among Ti: 0.01–1.0 wt %, Zr: 0.01–2.0 wt %, Hf: 0.01–2.0 wt %, V: 0.01–1.0 wt %, Nb: 0.01–2.0 wt % and Ta: 0.01–2.0 wt %, satisfying Ni wt $\% \geqq [0.67\ \{Cr+1.2\ (Si+Ti+Zr+Hf+V+Nb+Ta)\}-3]$ wt % and 0.02 wt $\% \leqq \{Ti+V+0.5\ (Zr+Nb)+0.25\ (Hf+Ta)\} \leqq 2.0$ wt %, and having a residue of Fe and inevitable impurities.

DESCRIPTION OF THE DRAWINGS

A complete understanding of the invention may be obtained from the foregoing and following description thereof, taken in conjunction with the appended drawings, in which.

Figure 1:
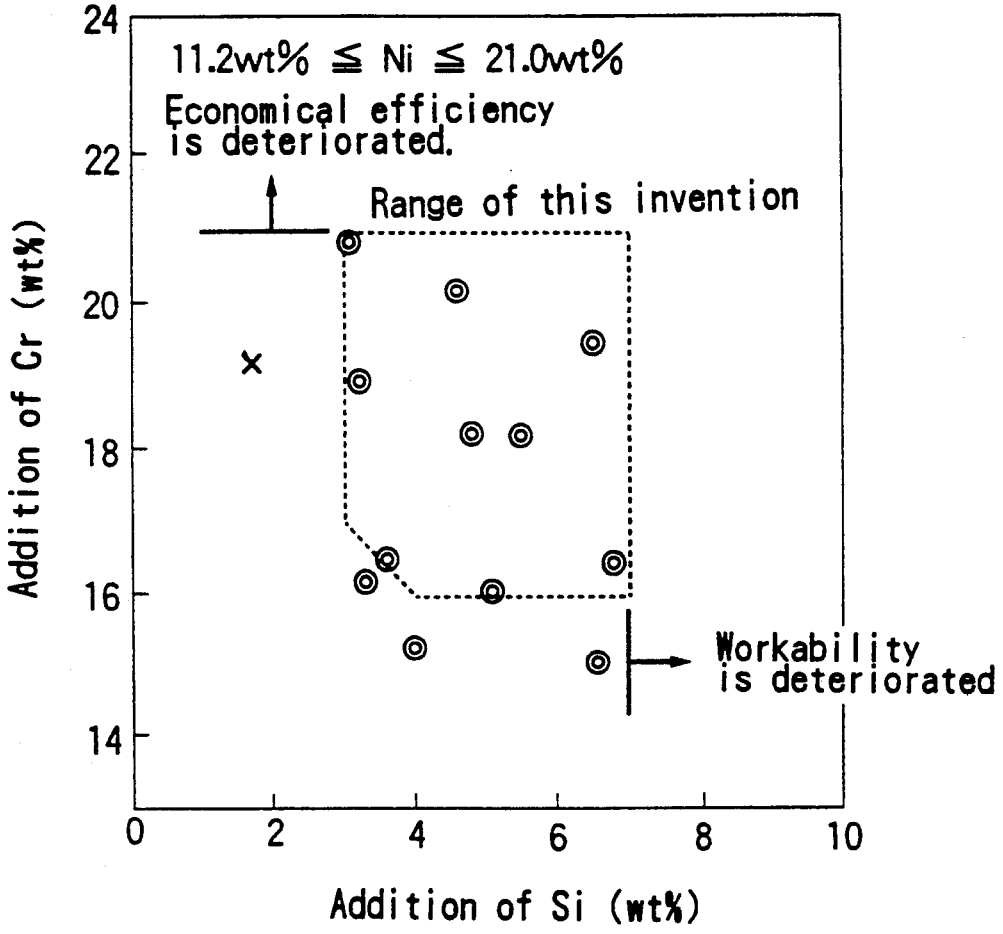
FIG. 1 is a graph showing the effect of the Cr and Si content on shape-memorizing properties of the Fe-Cr-Ni-Si shape-memory alloy concerned, in a working example of this invention.

In these drawings, the numeral 1 indicates a test-piece, the numeral 2 a strain gauge, the numeral 3 a holder, and the numeral 4 a clamping bolt.

DESCRIPTION OF PREFERRED EMBODIMENTS

The reason why the chemical composition of the ferrous-group shape-memory alloys of this invention is limited to the said range is as follows.

Cr acts to reduce the stacking fault energy of austenite and raise the yield strength of austenite, resulting in an improvement of shape-memorizing properties. Cr also acts to improve the intergranular corrosion resistance and stress corrosion cracking resistance of alloys. With a Cr content below 16.0 wt %, desired results cannot be obtained from the said actions. For this reason, the lower limit is specified as 16.0 wt %. On the other hand, if the Cr content exceeds 21.0 wt %, an economic disadvantage results. Thus, the Cr content should be limited within the range of 16.0–21.0 wt %.

Si acts to reduce the stacking fault energy of austenite and raise the yield strength of austenite, resulting in an improvement of shape-memorizing properties. Si also acts to increase the intergranular corrosion resistance and stress corrosion cracking resistance. However, with an Si content below 3.0 wt %, desired results cannot be obtained from the said actions. On the other hand, when the Si content exceeds 7.0 wt %, the ductility of the alloy is remarkably lowered, resulting in a marked deterioration in hot workability and cold workability. Accordingly, the Si content should be limited within the range of 3.0–7.0 wt %.

Ni is a strong element for the formation of austenite. Ni has the action of forming the base phase of the alloy prior to plastic deformation into mainly austenite. If the Ni content is less than 11.0 wt %, the desired effect of the said action cannot be obtained. Thus, the lower limit is specified as 11.0 wt %. On the other hand, if the Ni content exceeds 21.0 wt %, the $\epsilon$ martensite transformation temperature (hereinafter referred to as the "Ms point") is considerably shifted to the lower temperature area, thereby lowering the temperature at which the alloy undergoes plastic deformation and deteriorating the shape-memorizing properties. Thus, the upper limit is specified as 21.0 wt %. Accordingly, the Ni content must be limited within the range of 11.0–21.0 wt %.

In this invention, at least one of the following elements can be added in addition to the said Cr, Si and Ni.

Mn is a strong element for the formation of austenite and has the action of forming the base phase of the alloy prior to plastic deformation into mainly austenite. However, if the Mn content is less than 0.1 wt %, this action cannot be properly attained. On the other hand, if the Mn content exceeds 5.0 wt %, the intergranular corrosion resistance is deteriorated and the formation of $\sigma$ phase is greatly facilitated, thereby leading to a deterioration in the shape-memorizing properties. So the upper limit is specified as 5.0 wt %. That is, the Mn content must be limited within the range of 0.1–5.0 wt %.

Cu is an austenite-forming element, and has the action of forming the base phase of the alloy prior to plastic deformation into mainly austenite. A slight addition of Cu has the action of improving the resistance of the alloy to pitting by corrosion. However, if the Cu content is less than 0.1 wt %, the desired effects of the said actions cannot be obtained. On the other hand, if the Cu content exceeds 1.0 wt %, the formation of $\epsilon$ martensite is checked, thereby deteriorating the shape-memorizing properties. The reason for this is that Cu acts to raise the stacking fault energy of austenite. Accordingly, the Cu content should be limited within the range of 0.1–1.0 wt %.

N is an austenite-forming element, and has the action of forming the base phase of the alloy prior to plastic deformation into mainly austenite. A slight addition of N improves the resistance of the alloy to pitting by corrosion and raises the yield strength of austenite. When the N content is less than 0.001 wt %, the said actions cannot be properly attained. On the other hand, if the N content exceeds 0.100 wt %, nitrides of Cr and Si are easily formed, thereby the shape-memorizing properties of the alloy are deteriorated. Also, the intergranular corrosion resistance in nitric acid and the stress corrosion cracking resistance in high-temperature water are lowered. Even if the Ti, Zr, Hf, V, Nb and Ta to be described later are added within the range of this invention, satisfactory improvement cannot be obtained. Accordingly, the N content is limited within the range of 0.001–0.100 wt %.

Mo is an effective element for improving the intergranular corrosion resistance and stress corrosion cracking resistance. With a Mo content below 0.1 wt %, said effects are inadequate. Thus, the lower limit is specified as 0.1 wt %. However, an addition of more than 3.0 wt % deteriorates the shape-memorizing properties. Accordingly, the upper limit is specified as 3.0 wt %.

W is an effective element for improving the intergranular corrosion resistance and stress corrosion cracking resistance. With a W content below 0.1 wt %, the effect is inadequate. Also, the addition of more than 3.0 wt % deteriorates the shape-memorizing properties. Accordingly, the range is specified as 0.1-3.0 wt %. All of Ti, Zr, Hf, V, Nb and Ta are strong C and N stabilizing elements. By suppressing the precipitation of Cr carbide or Cr nitride at the crystalline boundary, the effect can be obtained of checking the deterioration of intergranular corrosion resistance and stress corrosion cracking resistance. Moreover, the inventors found that when the total content of C and N exceeds 0.01 wt %, the intergranular corrosion in nitric acid and the stress corrosion cracking resistance in high-temperature water were deteriorated by indispensable thermomechanical treatment to increase the shape-memorizing properties (for example, thermomechanical treatment of heating to 500°-700° C. after deformation at ambient temperature) even if the total content of the said elements is low enough (for example, 0.02 wt %) and no precipitation of Cr carbide and Cr nitride is found, and that addition of C and N stabilizing elements is effective against the deterioration of these characteristics. To obtain a satisfactory improvement effect by adding the said elements, the addition of 0.01 wt % or more of each element is required and $$0.02 \text{ wt } \% \leqq \{Ti+V+0.5(Zr+Nb)+0.25(Hf+Ta)\} \text{ wt } \% \leqq 2.0 \text{ wt } \%$$

must be satisfied. However, if these elements which are ferrite-forming elements are added copiously, the shape-memorizing properties are deteriorated in addition to the thermomechanical workability and weldability. Accordingly, the upper limit for Ti and V is specified as 1.0 wt % and the upper limit for the other elements is specified as 2.0 wt %.

If substantial amounts of P and S which are impurities are present, the thermomechanical workability and durability are deteriorated. Thus, the content of each element must be 0.1 wt % or less. Regarding C being an impurity, if 0.1 wt % or more is present, the intergranular corrosion resistance in nitric acid and the stress corrosion cracking resistance in high-temperature water cannot be satisfactorily improved even if the aforementioned Ti, Zr, Hf, V, Nb and Ta are added within the range of this invention. Thus, the C content must be 0.1 wt % or less. Regarding N, its content must be limited to 0.1 wt % or less for the same reason as C when it is present as an impurity. Regarding Co being an impurity, a content of 0.1 wt % or less is desirable considering the problem of activation in the environment of high-temperature deionized water (primary cooling water) of the nuclear power field.

With regard to the ratio of the total content of austenite-forming elements to the total content of ferrite-forming elements in this invention, as described above, the base phase of the alloy prior to subjecting the alloy to plastic deformation at a specified temperature must absolutely be composed mainly of austenite. Accordingly, in this invention, the following expression must be satisfied in addition to the foregoing limitation for the chemical composition.

$$Ni \text{ wt } \% \geqq [0.67\{Cr+1.2(Si+Ti+Zr+Hf+V+Nb+Ta)\}-3] \text{ wt } \% \{Ni+0.5Mn+0.06Cu+0.002(C+N)\} \text{ wt } \% \geqq [0.67\{Cr+1.2(Si+Ti+Zr+Hf+V+Nb+Ta)+Mo+W\}-3] \text{ wt } \%$$

That is, by satisfying the above expression, the base phase of the alloy prior to plastic deformation at a specified temperature can be formed into mainly austenite. The present invention relates to those alloys that are excellent not only in shape-memorizing properties, corrosion resistance and intergranular corrosion resistance but also in stress corrosion cracking resistance. To attain this excellent stress corrosion cracking resistance, the following expression for the total content of Cr content and Si content must be absolutely satisfied in addition to the foregoing limitation.

$$(Cr+Si) \text{ wt } \% \geqq 20 \text{ wt } \%$$

That is, by satisfying this expression, excellent stress corrosion cracking resistance can be attained.

Referring to a concrete working example according to this invention, the inventors and others melted the steel alloy based on this invention and the comparative steel alloy of the chemical composition out of the range of this invention as shown in the following Table 1, in a smelting furnace under vacuum and cast them into ingot. The ingot obtained in this way were heated to 1100°-1200° C. and then hot-rolled to a thickness of 12 mm. Steel alloy specimens of this invention (hereinafter referred to as "specimens of this invention") No. 1-19 and comparative steel alloy specimens out of the range of this invention (hereinafter referred to as "comparative specimens") No. 20-29 were prepared.

TABLE 1

| Alloy | No. | Chemical Composition (wt. %) Cr | Si | Ni | Mn | Cu | N | Mo | W | Shape-memorizing Property | Corrosion Resistance | Stress Corrosion Cracking Resistance: Assessment | Ratio of time to failure | Note |
|---|---|---|---|---|---|---|---|---|---|---|---|---|---|---|
| Specimens of this invention | 1 | 16.0 | 5.1 | 15.6 | — | — | — | — | — | ◎ | ○ | ○ | 0.94 | |
| | 2 | 18.3 | 4.8 | 16.0 | — | — | — | — | — | ◎ | ◎ | ○ | 1.0 | |
| | 3 | 20.9 | 3.0 | 17.8 | — | — | — | — | — | ◎ | ◎ | ○ | 1.0 | |
| | 4 | 20.2 | 4.6 | 20.2 | — | — | — | — | — | ◎ | ◎ | ○ | 1.0 | |
| | 5 | 16.5 | 6.8 | 21.0 | — | — | — | — | — | ◎ | ○ | ○ | 1.0 | |
| | 6 | 16.5 | 3.6 | 11.2 | — | — | — | — | — | ◎ | ○ | ○ | 0.91 | |
| | 7 | 19.5 | 6.5 | 20.8 | — | — | — | — | — | ◎ | ◎ | ○ | 1.0 | |
| | 8 | 18.2 | 5.5 | 18.4 | — | — | — | — | — | ◎ | ◎ | ○ | 1.0 | |
| | 9 | 19.0 | 3.4 | 17.7 | — | — | — | — | — | ◎ | ◎ | ○ | 1.0 | |
| | 10 | 18.1 | 4.7 | 15.5 | 1.1 | — | 0.003 | — | — | ◎ | ◎ | ○ | 1.0 | |
| | 11 | 18.4 | 5.0 | 16.6 | 0.9 | — | 0.005 | — | — | ◎ | ◎ | ○ | 1.0 | |
| | 12 | 18.6 | 5.5 | 18.2 | 1.3 | — | 0.010 | — | — | ◎ | ◎ | ○ | 1.0 | |
| | 13 | 18.4 | 4.6 | 16.3 | 1.0 | 0.3 | 0.006 | — | — | ◎ | ◎ | ○ | 1.0 | |
| | 14 | 17.0 | 4.7 | 15.7 | 5.0 | 0.9 | — | — | — | ◎ | ○ | ○ | 0.97 | |
| | 15 | 18.5 | 4.4 | 16.0 | — | — | 0.095 | — | — | ◎ | ◎ | ○ | 1.0 | |

TABLE 1-continued

| Alloy No. | | Chemical Composition (wt. %) Cr | Si | Ni | Mn | Cu | N | Mo | W | Shape-memorizing Property | Corrosion Resistance | Stress Corrosion Cracking Resistance Assessment | Ratio of time to failure | Note |
|---|---|---|---|---|---|---|---|---|---|---|---|---|---|---|
| | 16 | 16.4 | 4.6 | 18.9 | — | — | — | 2.8 | — | ◎ | ◎ | ○ | 0.95 | |
| | 17 | 16.6 | 4.3 | 19.0 | — | — | — | — | 2.7 | ◎ | ◎ | ○ | 0.94 | |
| | 18 | 16.2 | 4.4 | 18.8 | — | — | — | 1.4 | 1.5 | ◎ | ◎ | ○ | 0.92 | |
| | 19 | 16.1 | 4.5 | 17.8 | 1.0 | 0.3 | 0.006 | 1.5 | 1.6 | ◎ | ◎ | ○ | 0.93 | |
| Comparative | 20 | 15.3 | 4.0 | 14.3 | — | — | — | — | — | ◎ | X | X | 0.75 | |
| specimens | 21 | 15.1 | 6.5 | 17.0 | — | — | — | — | — | ◎ | X | X | 0.80 | |
| | 22 | 16.2 | 3.3 | 15.2 | — | — | — | — | — | ◎ | ○ | X | 0.85 | |
| | 23 | 19.2 | 1.6 | 13.9 | — | — | — | — | — | X | ◎ | X | 0.88 | Impossible to machine |
| | 24 | 18.1 | 7.4 | 20.2 | — | — | — | — | — | — | — | — | | |
| | 25 | 18.1 | 4.9 | 16.8 | 5.8 | — | — | — | — | X | X | ○ | 1.0 | |
| | 26 | 17.9 | 5.2 | 15.9 | — | 1.5 | — | — | — | X | ◎ | ○ | 1.0 | |
| | 27 | 18.6 | 4.4 | 16.3 | — | — | 0.112 | — | — | X | ◎ | ○ | 1.0 | |
| | 28 | 16.5 | 4.3 | 18.0 | — | — | — | 3.3 | — | X | ◎ | ○ | 0.95 | |
| | 29 | 16.5 | 4.7 | 18.8 | — | — | — | — | 3.2 | X | ◎ | ○ | 0.96 | |

Regarding specimens No. 1–19 of this invention and comparative specimens No. 20–29 obtained in the said way, the shape-memorizing properties, corrosion resistance and stress corrosion cracking resistance were investigated in the following tests. The results of these tests are shown together in Table 1.

(1) Shape memorizing properties

From each of specimens No. 1–19 of this invention and comparative specimens No. 20–29, a round-shape bar test-piece with a diameter of 6 mm and a mark-to-mark distance of 30 mm was cut out. A tensile strain of 4% was added at −196° C. to each test-piece thus formed. Next, each test-piece was heated to a specified temperature (300° C. or more) exceeding, but close to, the Af point and the said tensile strain was added. The mark-to-mark distance of each test-piece after each stage was measured. According to the result of mark-to-mark measurements, the shape-recovery rate was calculated by the following expression to evaluate the shape-memorizing properties of each specimen. (Strictly speaking, the Ms point slightly differs with specimens. However, the optimum temperature for plastic deformation was unified to −196° C. for testing.)

The result of the said tensile test is shown in the column "Shape memorizing properties" of the foregoing Table 1 and the data on specimens No. 1–9 of this invention and comparative specimens No. 20–23 are shown in FIG. 1. The criteria for shape-memorizing properties are as follows.

◎: Shape recovery rate=70% or more
○: Shape recovery rate=30% - below 70%
×: Shape recovery rate=Below 30%

$$\text{Shape recovery rate (\%)} = \frac{L_1 - L_2}{L_1 - L_0} \times 100$$

where $L_0$: First mark-to-mark distance of test-piece;
$L_1$: Mark-to-mark distance of test-piece after addition of tensile strain; and
$L_2$: Mark-to-mark distance of test-piece after heating In FIG. 1, the abscissa indicates the Si content (wt %) and the ordinate indicates the Cr content (wt %). In FIG. 1, the range enclosed by the dotted line shows that the Cr content and Si content are within the range of this invention. The mark ◎ denotes that the shape-recovery rate is 70% or more, the mark ○ denotes that the shape-recovery rate is not less than 30% and less than 70%, the mark × denotes that the shape-recovery rate is less than 30%. As FIG. 1 is self-explanatory, the specimens having a Ni content in the range of 11.0–21.0 wt %, a Cr content within 16.0–21.0 wt % and a Si content within 3.0–7.0 wt %, show excellent shape-recovery properties.

Comparative specimen "23" having 1.6 wt % Si out of the range of this invention has only very low shape-recovery properties. In FIG. 1, comparative specimens "20", "21" and "22" out of the range of this invention resulted in the mark ◎ but are inferior in corrosion resistance and stress corrosion cracking resistance as described later.

(2) Corrosion resistance

For each of specimens No. 1–19 of this invention and comparative specimens No. 20–29, an atmospheric exposure test was executed over a 3 year period to check their corrosion resistance. After completion of the said test, the rust occurrence condition of each specimen was visually evaluated.

The criteria for the occurrence of rust are as follows:
◎: The occurrence of rust can not be observed.
○: The occurrence of rust can be slightly observed.
×: The substantial occurrence of rust can be observed.

Figure 2:
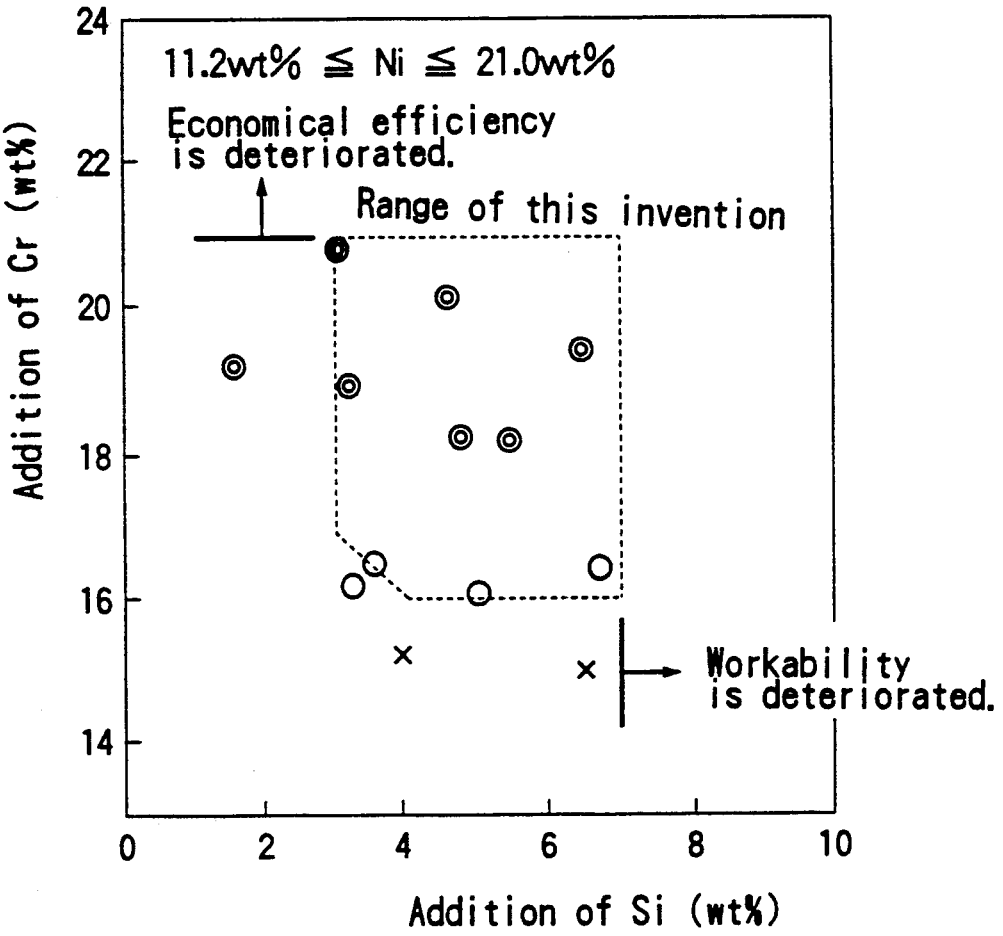
FIG. 2 is a graph showing the effect of the Cr and Si content on corrosion resistance of the Fe-Cr-Ni-Si shape-memory alloy concerned, in a working example of this invention.

The results of the said test are shown in the column "Corrosion Resistance" in Table 1, and the results on specimens No. 1–9 of this invention and comparative specimens No. 20–23 are also shown in FIG. 2.

Figure 5:
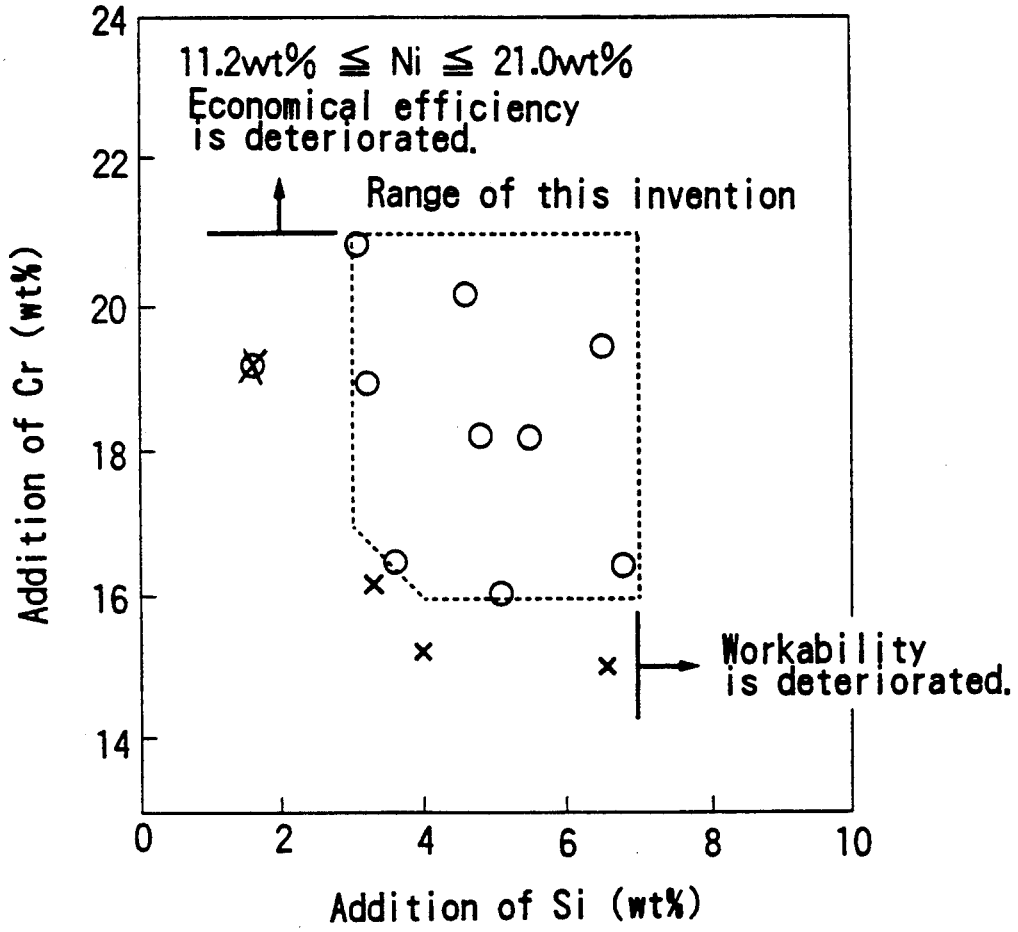
FIG. 5 is a graph showing the effect of the Cr and Si content on stress corrosion cracking resistance of the Fe-Cr shape memory alloy concerned, in a working example of this invention.

As Table 1 and FIG. 2 are self-explanatory, the specimens within the range of this invention show excellent corrosion resistance. Because comparative specimen No. 23 out of the range of this invention was inferior in shape-memorizing properties as shown in Table 1 and FIG. 1, it is not included in the claims of this invention. Comparative specimen No. 22, which was inferior in stress corrosion cracking resistance as shown in Table 1 and FIG. 5, is also not included in the claims of this invention.

(3) Stress corrosion cracking resistance

Figure 3:
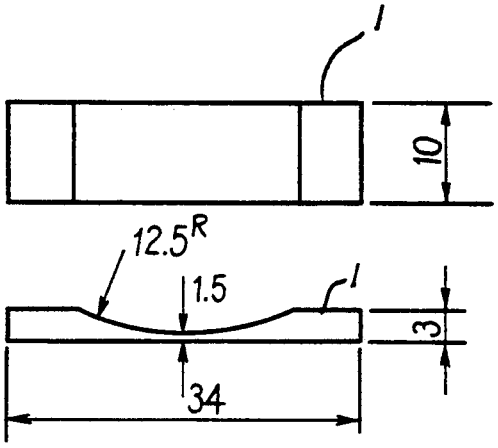
FIG. 3 is an explanatory drawing of the shape of the stress corrosion cracking test-piece used in a working example of this invention.
Figure 4:
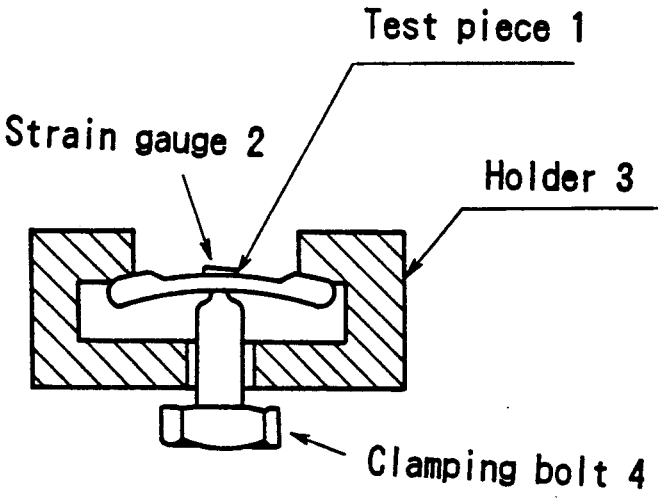
FIG. 4 is an explanatory partial cross-section view of the method of loading stress on the stress cracking test-piece used in a working example of this invention.

From each of specimens No. 1–19 of this invention and comparative specimens No. 20–29, a test-piece shown in FIG. 3 was cut out and each test-piece thus cut out was set in holder 3 shown in FIG. 4. Next, strain gauge 2 was fixed on test-piece 1 and clamping bolt 4 was forced in. Strain corresponding to a specified stress (yield stress) was given, and the test-piece was dipped under the stress corrosion cracking test conditions shown in the following Table 2. After a period of 3000 h, the surface of the test-piece was checked for cracking. Thus, the stress corrosion cracking resistance of each specimen was evaluated.

TABLE 2

| Stress Corrosion Cracking Test Conditions | |
|---|---|
| Temperature | 300° C. |
| Residual oxygen concentration | 8 ppm |
| Cl | 0.01 ppm or less |
| pH (at 25° C.) | 7 ± 0.2 |

The results of the said stress corrosion cracking test are shown in the column "stress corrosion cracking resistance" in Table 1, and results on specimens No. 1–9 of this invention and comparative specimens No. 20–23 are also shown in FIG. 5.

The criteria for the occurrence of cracking in the said stress corrosion cracking test are as follows.

○: The occurrence of cracking can not be observed. (No cracking)

X: The occurrence of cracking can be observed. (Occurrence of cracking)

In FIG. 5, the abscissa shows the Si content (wt %) and the ordinate shows the Cr content (wt %). In this FIG. 5, the range enclosed by the dotted line shows that the Cr content and Si content are within the range of this invention. In FIG. 5, the mark "○" denotes that no cracking was observed and the mark "X" denotes that cracking was observed.

As FIG. 5 is self-explanatory, the specimens having a Ni content within the range of 11.0–21.0 wt %, and the specimens having a Cr content within the range of 16.0–21.0 wt % and a Si content within the range of 3.0–7.0 wt % show excellent stress corrosion cracking resistance. Conversely, comparative specimen "20" having a Cr content of 15.3 wt % which is out of the range of this invention, comparative specimen "21" having a Cr content of 15.1 wt %, and comparative specimen "22" having a total content of Cr and Si of 19.5 wt %, namely, less than 20 wt %, and comparative specimen "23" having a Si content of 1.6 wt % are insufficient in stress corrosion cracking resistance.

Figure 6:
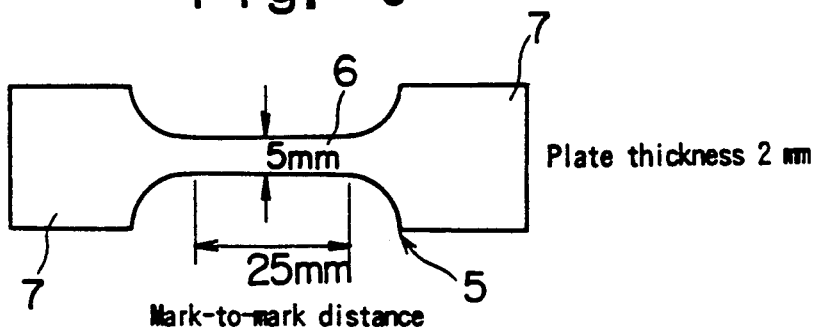
FIG. 6 shows a plan view of the tensile test-piece prepared in order to determine the ratio of time to failure from the specimen in a working example of this invention and in comparative examples.

Moreover, the inventors made a study of this stress corrosion cracking resistance and prepared each 2 mm thick test-piece 5 of a mark-to-mark distance of 25 mm in the test part 6 with a width of 5 mm between the holding parts 7 at both ends, shaped as shown in FIG. 6 by using the said specimens 1–19, 20–23 and 25–29 shown in Table 1.

The tensile test conditions for each said test-piece are as shown in the following Table 3 and the times to failure obtained by these tests were evaluated.

TABLE 3

| | In high-temp, high-pressure water | In high-temp atmosphere |
|---|---|---|
| Test Temp | 320° C. | 320° C. |
| Pressure | 180 atmospheres | Atmospheric pressure |
| Atmosphere | water (residual oxygen: 8 ppm) | air |
| Strain rate | $3 \times 10^{-6}$/sec | $3 \times 10^{-6}$/sec |

Figure 7:
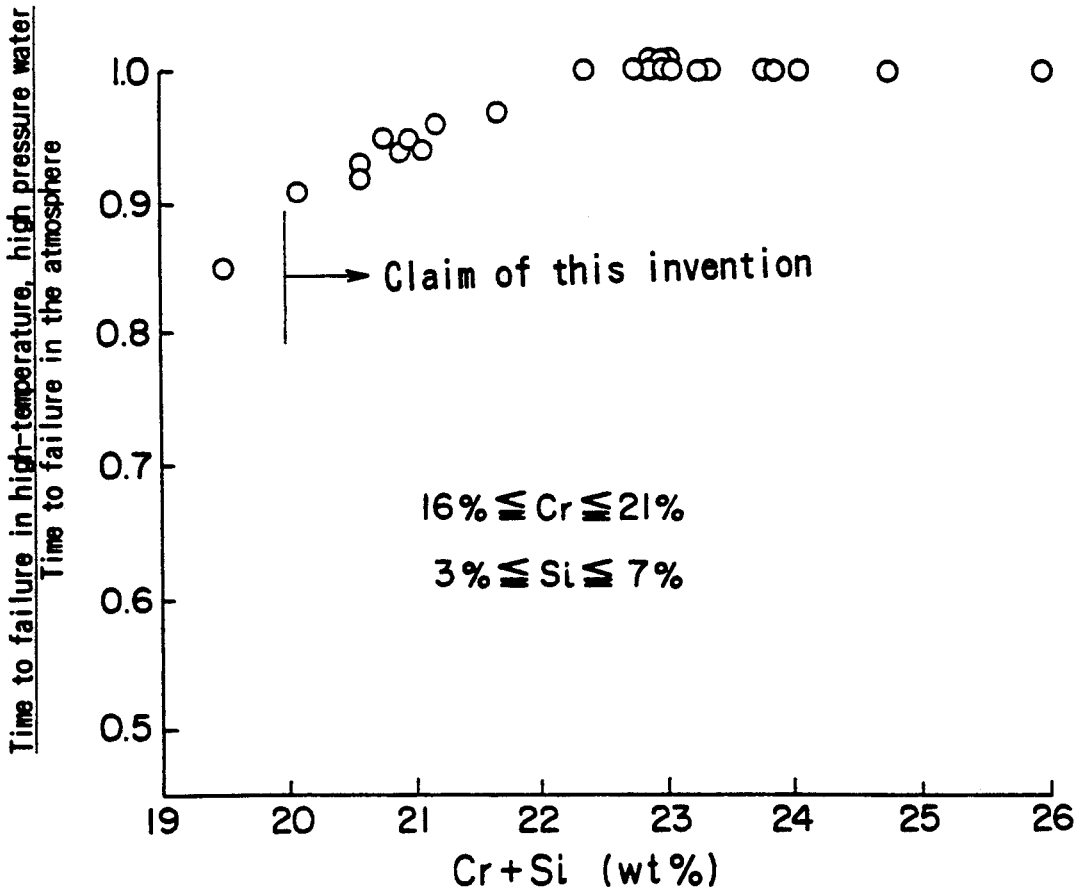
FIG. 7 is a graph showing the relationship between the ratio of time to failure obtained from the time to failure in a tensile test in high-temperature, high-pressure water and a high-temperature atmosphere with each test-piece shown in FIG. 6, and an amount of Cr and Si content.

Regarding the obtained results, (time to failure in high-temperature, high-pressure water)/(time to failure in atmospheric pressure air), namely, the ratio of time to failure is included in the foregoing Table 1. The relationship between this ratio of time to failure and the content of {Cr+Si} (wt %) of each specimen is shown in FIG. 7.

That is, it was confirmed by this invention that when the content of {Cr+Si} became 20 wt % or more, the said ratio of time to failure became 0.9 or more and the same failure properties as in atmosphere pressure air were shown in high-temperature, high-pressure water.

Referring to another concrete working example of this invention, the inventors melted the steel alloy (No. 31–50) based on this invention and the comparative steel alloy (No. 51–61) with chemical compositions out of the range of this invention, shown in the following Table 4, in a smelting furnace under vacuum and cast them into ingot. The ingot thus obtained were heated to 1100°–1200° C. and then hot rolled to a thickness of 12 mm to provide specimens. Regarding each specimen, the shape-memorizing properties, intergranular corrosion resistance and stress corrosion cracking resistance were checked in the following tests. The results of these tests are shown together in Table 4.

TABLE 4

| Alloy No. | | Chemical Composition (wt. %) Cr | Si | Ni | Mn | Cu | Mo | W | C | N | Others | Shape-memorizing Property | Inter-granular Corrosion Resistance | Stress Corrosion Cracking Resistance | Note |
|---|---|---|---|---|---|---|---|---|---|---|---|---|---|---|---|
| Specimens of this invention | 31 | 16.2 | 5.4 | 15.8 | | | | | 0.02 | 0.01 | 0.2Ti | ◎ | ○ | ○ | |
| | 32 | 18.0 | 4.5 | 16.5 | | | | | 0.02 | 0.01 | 0.3Nb | ◎ | ◎ | ○ | |
| | 33 | 20.4 | 3.2 | 18.7 | | | | | 0.01 | 0.02 | 0.1Ti, 0.3Ta | ◎ | ◎ | ○ | |
| | 34 | 16.5 | 3.6 | 12.0 | | | | | 0.01 | 0.01 | 0.1V | ◎ | ○ | ○ | |
| | 35 | 16.6 | 6.8 | 20.8 | | | | | 0.01 | 0.01 | 0.2Zr | ◎ | ◎ | ○ | |
| | 36 | 18.5 | 5.0 | 17.3 | | | | | 0.02 | 0.01 | 0.2Zr, 0.2Hf | ◎ | ◎ | ○ | |
| | 37 | 20.1 | 6.5 | 19.7 | | | | | 0.02 | 0.01 | 0.1Ti, 0.1Nb | ◎ | ◎ | ○ | |
| | 38 | 18.2 | 3.0 | 14.0 | | | | | 0.01 | 0.01 | 0.4Ta | ◎ | ◎ | ○ | |
| | 39 | 18.5 | 4.5 | 15.0 | 1.0 | | | | 0.01 | 0.01 | 0.1Ti | ◎ | ◎ | ○ | |
| | 40 | 18.4 | 4.6 | 15.2 | 2.2 | | | | 0.01 | 0.01 | 0.2Ti | ◎ | ◎ | ○ | |
| | 41 | 18.3 | 4.4 | 15.0 | 1.0 | 0.4 | | | 0.01 | 0.01 | 0.05Ti | ◎ | ◎ | ○ | |
| | 42 | 18.4 | 4.5 | 14.1 | 4.1 | 0.8 | | | 0.02 | 0.01 | 0.3Nb | ◎ | ◎ | ○ | |
| | 43 | 18.0 | 4.2 | 16.8 | | | 1.2 | | 0.02 | 0.02 | 0.1Ti, 0.2Nb | ◎ | ◎ | ○ | |
| | 44 | 16.3 | 4.2 | 18.5 | | | 2.7 | | 0.02 | 0.02 | 0.1Ti, 0.2Zr | ◎ | ◎ | ○ | |
| | 45 | 17.2 | 3.8 | 15.9 | | | | 0.9 | 0.01 | 0.02 | 0.4Zr | ◎ | ◎ | ○ | |
| | 46 | 17.2 | 4.3 | 17.9 | | | | 2.4 | 0.01 | 0.02 | 0.2V | ◎ | ◎ | ○ | |
| | 47 | 16.8 | 4.5 | 15.3 | 1.0 | | 1.5 | | 0.01 | 0.01 | 0.2Nb | ◎ | ◎ | ○ | |
| | 48 | 17.0 | 4.4 | 15.6 | 1.0 | | | 1.0 | 0.02 | 0.01 | 0.2Ti | ◎ | ◎ | ○ | |
| | 49 | 18.8 | 3.8 | 17.2 | 1.2 | | 0.9 | 1.3 | 0.02 | 0.01 | 0.2Ti | ◎ | ◎ | ○ | |

TABLE 4-continued

| Alloy No. | | Chemical Composition (wt. %) Cr | Si | Ni | Mn | Cu | Mo | W | C | N | Others | Shape-memorizing Property | Inter-granular Corrosion Resistance | Stress Corrosion Cracking Resistance | Note |
|---|---|---|---|---|---|---|---|---|---|---|---|---|---|---|---|
| | 50 | 19.2 | 5.0 | 19.0 | 1.9 | 0.5 | 1.8 | 0.5 | 0.02 | 0.02 | 0.06Ti | ◎ | ◎ | ○ | |
| Comparative specimens | 51 | 15.2 | 3.5 | 14.5 | | | | | 0.01 | 0.01 | 0.1Ti | ◎ | X | X | |
| | 52 | 15.0 | 6.2 | 17.7 | | | | | 0.01 | 0.01 | 0.1Ti, 0.1Nb | ◎ | X | X | |
| | 53 | 17.1 | 1.8 | 13.9 | | | | | 0.01 | 0.02 | 0.4Zr | X | X | X | |
| | 54 | 18.3 | 2.6 | 15.0 | | | | | 0.01 | 0.01 | 0.2Nb | ○ | ○ | X | |
| | 55 | 18.2 | 4.9 | 16.8 | 1.0 | | | | 0.02 | 0.02 | 0.01Ti | ◎ | X | X | |
| | 56 | 18.0 | 4.5 | 15.5 | 1.0 | 0.3 | 0.8 | | 0.02 | 0.01 | | ◎ | X | X | |
| | 57 | 20.5 | 4.6 | 20.2 | | 0.3 | 1.5 | 1.6 | 0.01 | 0.02 | | ◎ | X | X | |
| | 58 | 18.1 | 4.7 | 16.9 | 5.7 | 1.5 | | | 0.02 | 0.01 | 0.2Ti | X | X | X | |
| | 59 | 18.6 | 4.4 | 15.9 | 1.0 | 0.2 | 3.8 | | 0.01 | 0.01 | 0.2Nb | X | ◎ | ○ | |
| | 60 | 18.0 | 5.9 | 17.0 | 1.0 | | | 3.5 | 0.01 | 0.01 | 0.2Nb | X | ◎ | ○ | |
| | 61 | 18.0 | 7.5 | 17.1 | 1.0 | | | | 0.01 | 0.01 | 0.1Ti | — | — | — | Impossible to machine |

Each property in the foregoing Table 4 is as follows:

(1) Shape-memorizing properties

From each of specimen alloys No. 31–50 of this invention and comparative specimen alloys No. 51–60, a round-shape bar test-piece with a diameter of 6 mm and a mark-to-mark distance of 30 mm was cut out and a tensile strain of 4% was added at −196° C. to each test-piece thus cut out. Next, each test-piece was heated to a specified temperature (300° C. or more) exceeding, but close to, the Af point and the said tensile strain was added. The mark-to-mark distance of each test-piece after heating was measured. According to the result of mark-to-mark measurement, the shape-recovery rate was calculated by the following expression to evaluate the shape-memorizing properties of each specimen alloy. (Actually, the Ms point differs with specimen alloys. However, the optimum temperature for giving plastic deformation was unified to −196° C. for test purposes.)

Figure 8:
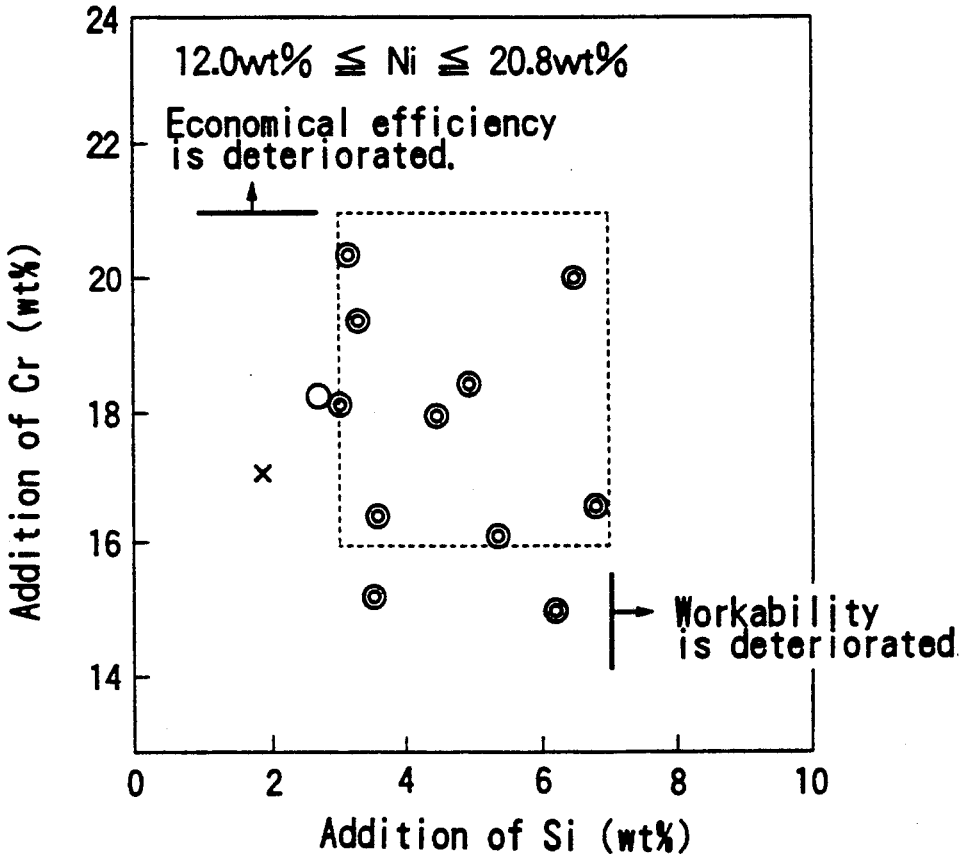
FIG. 8 is a graph showing the effect of the Cr and Si content on shape-memorizing properties of the Fe-Cr-Ni-Si shape memory alloy concerned, in another working example of this invention.

The results of the said shape memorizing property tests are shown in the column "Shape-Memorizing Properties" in the foregoing Table 4 and the results on alloys No. 31–38 of this invention and comparative alloys No. 51–54 are shown in FIG. 8. The criteria used here for shape-memorizing properties are the same as those for the preceding working example.

In FIG. 8, the abscissa indicates the Si content (wt %) and the ordinate indicates the Cr content (wt %). In this FIG. 1, the range enclosed by the dotted line shows that the Cr content and Si content are within the range of this invention. The evaluation of the shape-recovery rate is the same as that for the preceding working example in FIG. 1. As FIG. 8 is self-explanatory, the specimen alloys having an Ni content within the range of 11.0–21.0 wt %, a Cr content within the range of 16.0–21.0 wt % and an Si content within the range of 3.0–7.0 wt % show excellent shape-memorizing properties.

The comparative alloy "53" containing 1.8 wt % Si which is out of the range of this invention has only very low shape-memorizing properties. The comparative alloy "54" containing 2.6 wt % Si shows shape-memorizing properties belonging to this mark "○" but is inferior to the evaluation of the alloys of the invention and also inferior in the intergranular corrosion resistance and stress corrosion cracking resistance as described later. In FIG. 8, the comparative alloys "51" and "52" which are out of the range of this invention also show sufficient shape-memorizing properties but are inferior in intergranular corrosion resistance and stress corrosion cracking resistance as described later.

(2) Intergranular corrosion resistance

Figure 9:
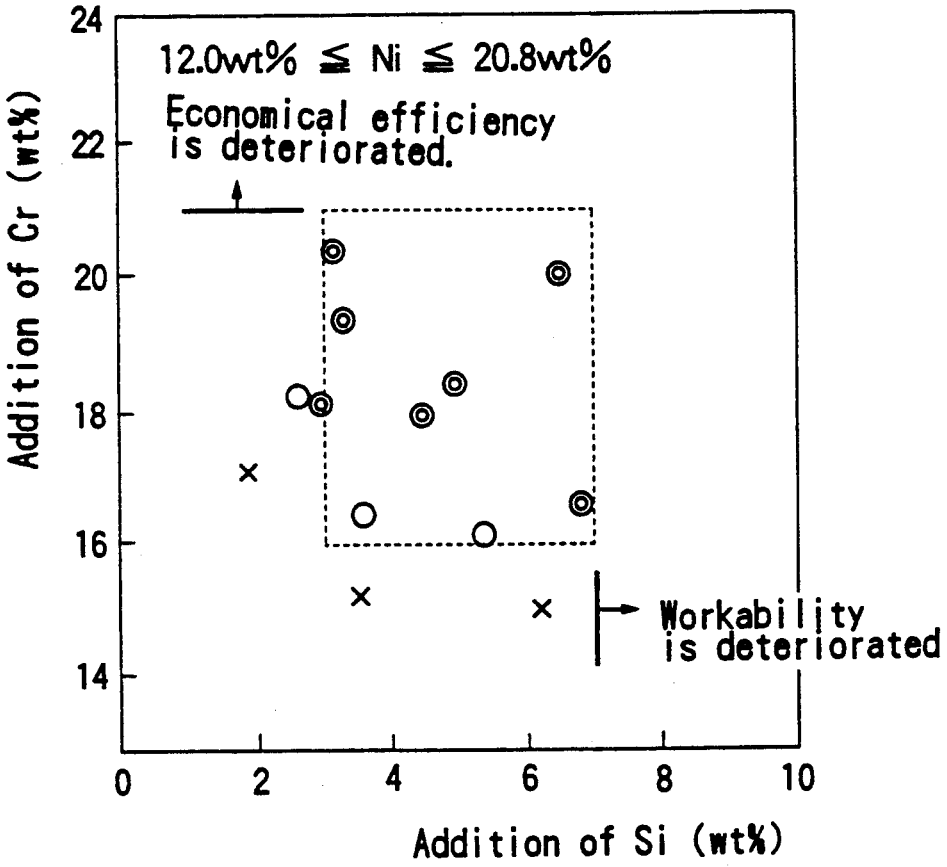
FIG. 9 is a diagram showing the effect of the Cr and Si content on intergranular corrosion resistance of the Fe-Cr-Ni-Si alloy concerned, in another working example of this invention.

From each of alloys No. 31–50 of this invention and comparative alloys No. 51–60, a plate-shaped test-piece with a thickness of 4 mm, a width of 20 mm and a length of 100 mm was cut out. A tensile strain of 4% was given at ambient temperature and then heated to 600° C. This was repeated 3 times. After that, a plate-shaped test-piece for corrosion testing with a thickness of 2 mm, a width of 15 mm and a length of 20 mm was cut out from each said plate-shaped test-piece. This test-piece was dipped in boiled 40% nitric acid after its surface was wet-polished up to #600. After 5-days' dipping, the cross-section of the test-piece was observed with an optical microscope and the maximum intergranular corrosion depth was checked to evaluate the intergranular corrosion resistance. The results of the intergranular corrosion test are shown in the column "Intergranular corrosion resistance" in the foregoing Table 4 and the data on alloys No. 31–38 of this invention and comparative alloys No. 51–54 is shown in FIG. 9. The criteria for intergranular corrosion resistance are as follows.

◎: The maximum corrosion depth is less than 10 μm;

○: The maximum corrosion depth is not less than 10 μm and not more than 30 μm; and X: The maximum corrosion depth is not less than 30 μm.

As Table 4 and FIG. 9 are self-explanatory, the alloys having an Ni content within the range of 11.0–21 wt %, a Cr content within the range of 16.0–21.0 wt % and a Si content within the range of 3.0–7.0 wt % show excellent intergranular corrosion resistance.

The comparative alloys "51" and "52" having a Cr content of less than 16 wt % which are out of the range of this invention, the comparative alloy "53" having a Si content of 1.8 wt %, and the comparative alloys "55", "56" and "57" with insufficient addition or no addition of C and N stabilizing elements such as Ti and the comparative alloy "58" with the addition of more than 5.0 wt % Mn show poor intergranular corrosion resistance. The comparative alloy "54" with a Si content of 2.6 wt % is evaluated as mark "○" but is inferior in stress corrosion cracking resistance as described later.

The comparative alloys "59" and "60" with an addition of 3.0 wt % or more Mo and W show excellent intergranular corrosion resistance but are inadequate in shape-memorizing properties.

(3) Stress corrosion cracking resistance

From each of alloys No. 31-50 of this invention and comparative alloys No. 51-60, similar to those of the preceding working example, a plate-shaped test-piece with a thickness of 4 mm, a width of 20 mm and a length of 100 mm was cut out. Then, a tensile strain of 4% was given at ambient temperature and then heated to 600° C. This was repeated 3 times. After that, the test-piece shown in FIG. 3 was cut out from each said plate-shaped test-piece. Each test-piece thus cut out was set in the holder 3 shown in FIG. 4. After that, the strain gauge 2 was fixed on test-piece 1 and clamping bolt 4 was forced in. The strain corresponding to a specified stress (yield stress) was given, and the test-piece was dipped under the same stress corrosion cracking test conditions as shown in the working example in Table 2. After a period of 3000 h, the surface of the test-piece was checked for cracking. Thus, the stress corrosion cracking resistance of each alloy was evaluated.

Figure 10:
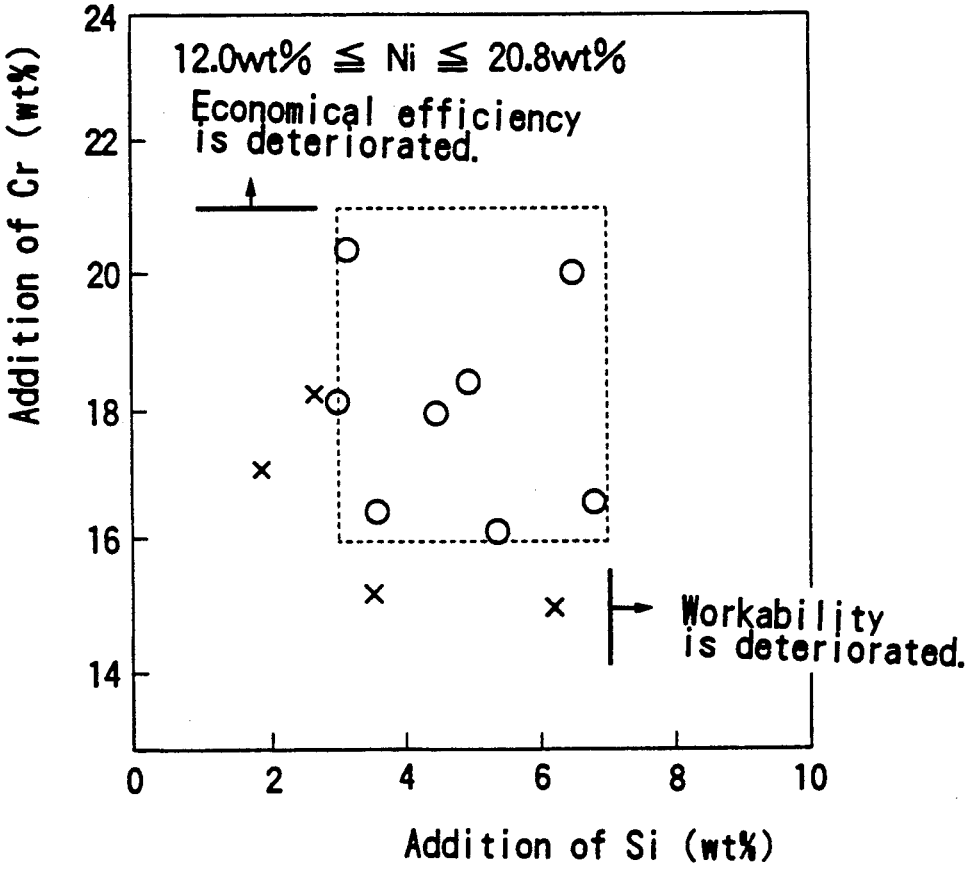
FIG. 10 is a graph showing the effect of the Cr and Si content on stress corrosion cracking resistance of the Fe-Cr-Ni-Si shape memory alloy concerned, in another working example of this invention.

The results of the said stress corrosion cracking test are shown in the column "Stress corrosion cracking resistance" in Table 4 and the results on alloys No. 31-38 of this invention and comparative alloys No. 51-54 are shown in FIG. 10. The criteria for the occurrence of cracking in this stress corrosion cracking test are the same as for the preceding working example. FIG. 10 shows the effect of the Cr and Si content on stress corrosion cracking resistance of Fe-Cr-Ni-Si shape memory alloys in the working examples of this invention. In this FIG. 10, the abscissa shows the Si content (wt %) and the ordinate shows the Cr content (wt %). In this FIG. 10, the range enclosed by the dotted line shows that the Cr and Si content are within the range of this invention. In FIG. 10, the mark "○" denotes that no cracking was observed and the mark "x" denotes that cracking was observed.

As Table 4 and FIG. 10 are self-explanatory, the alloys having an Ni content within the range of 11.0-21.0 wt %, a Cr content within the range of 16.0-21.0 wt % and a Si content within the range of 3.0-7.0 wt % show excellent stress corrosion cracking resistance. On the other hand, the comparative alloys "51" and "52" containing less than 16.0 wt % Si which is out of the range of this invention, the comparative alloy "53" containing 1.8 wt % Si, the comparative alloy "54" containing 2.6 wt % Si, the comparative alloys "55", "56" and "57" with insufficient addition or no addition of C and N stabilizing elements such as Ti, and the comparative alloy "58" with an addition of Mn exceeding 5.0 wt % are inferior in stress corrosion cracking resistance. The comparative alloys "59" and "60" with addition of 3.0 wt % or more Mo and W show excellent stress corrosion cracking resistance but are inadequate in shape-memorizing properties.

We claim:

1. Fe-Cr-Ni-Si shape memory alloys with excellent intergranular corrosion resistance and stress corrosion cracking resistance, consisting essentially of Cr: 16.0-21.0 wt %, Si: 3.0-7.0 wt % and Ni: 11.0-21.0 wt % and any one or two or more of Ti: 0.01-1.0 wt %, Zr: 0.01-2.0 wt %, Hf: 0.01-2.0 wt %, V: 0.01-1.0 wt %, Nb: 0.01-2.0 wt % and Ta: 0.01-2.0 wt %, satisfying Ni wt $\% \geqq \{0.67(Cr+1.2(Si+Ti+Zr+Hf+V+Nb+Ta))-3\}$ wt % and 0.02 wt $\% \leqq \{Ti+V+0.5(Zr+Nb)+0.25(Hf+Ta)\}$ wt $\% \leqq 2.0$ wt % and having a residue of Fe and inevitable impurities.

2. Fe-Cr-Ni-Si shape memory alloys with excellent intergranular corrosion resistance and stress corrosion cracking resistance, consisting essentially of Cr: 16.0-21.0 wt %, Si: 3.0-7.0 wt % and Ni: 11.0-21.0 wt %, any one or two or more of Mn: 0.1-5.0 wt %, Cu: 0.1-1.0 wt %, N: 0.001-0.100 wt %, Mo: 0.1-3.0 wt % and W: 0.1-3.0 wt %, any one or two or more of Ti: 0.01-1.0 wt %, Zr: 0.01-2.0 wt %, Hf: 0.01-2.0 wt %, V: 0.01-1.0 wt %, Nb: 0.01-2.0 wt % and Ta: 0.01-2.0 wt %, satisfying $(Ni+0.5Mn+0.06Cu+0.002(C+N))$ wt $\% \geqq [0.67\{Cr+1.2(Si+Ti+Zr+Hf+V+Nb+Ta)+Mo+W\}-3]$ wt % and 0.02 wt $\% \leqq \{Ti+V+0.5(Zr+Nb)+0.25(Hf+Ta)\}$ wt $\% \geqq 2.0$ wt %, and having a residue of Fe and inevitable impurities.

3. The alloy according to claim 1, which consists essentially of 16.2 to 20.4 wt. % Cr, 3.0 to 6.8 wt. % Si, 14.0 to 20.8 wt. % Ni and any one or two or more of 0.1 to 0.2 wt. % Ti, 0.2 wt. % Zr, 0.2 wt. % Hf, 0.1 wt. % V, 0.1 to 0.3 wt. % Nb and 0.3-0.4 wt. % Ta.

4. The alloy according to claim 1, which consists essentially of 16.6 to 20.4 wt. % Cr, 3.0 to 6.8 wt. % Si, 14.0 to 20.8 wt. % Ni and any one or two or more of 0.1 wt. % Ti, 0.3 to 0.4 wt. % Ta, 0.1 to 0.3 wt. % Nb, 0.2 wt. % Zr and 0.1 wt. % Hf.

5. The alloy according to claim 2, which consists essentially of 16.3 to 19.2 wt. % Cr, 3.8 to 5.0 wt. % Si, 14.1 to 19.0 wt. % Ni, 1.0 to 2.2 wt. % Mn, 0.4 to 0.8 wt. % Cu, 0.9 to 2.7 wt. % Mo, 0.5 to 2.4 wt. % W, and any one or two or more of 0.05 to 0.2 wt. % Ti, 0.2 to 0.3 wt. % Nb, 0.2 to 0.4 wt. % Zr and 0.2 wt. % V.

6. The alloy according to claim 1, which consists essentially of 16.2 wt. % Cr, 5.4 wt. % Si, 15.8 wt % Ni, 0.02 wt % C, 0.01 wt % N and 0.2 wt % Ti.

7. The alloy according to claim 1, which consists essentially of 18.0 wt % Cr, 4.5 wt % Si, 16.5 wt % Ni, 0.02 wt % C, 0.01 wt % N and 0.3 wt % Nb.

8. The alloy according to claim 1, which consists essentially of 20.4 wt % Cr, 3.2 wt % Si, 18.7 wt % Ni, 0.01 wt % C, 0.02 wt % N, 0.1 wt % Ti and 0.3 wt % Ta.

9. The alloy according to claim 1, which consists essentially of 16.5 wt % Cr, 3.6 wt % Si, 12.0 wt % Ni, 0.01 wt % C, 0.01 wt % N and 0.01 wt % V.

10. The alloy according to claim 1, which consists essentially of 16.6 wt % Cr, 6.8 wt % Se, 20.8 wt % Ni, 0.01 wt % C, 0.01 wt % N and 0.2 wt % Zr.

11. The alloy according to claim 1, which consists essentially of 18.5 wt % Cr, 5.0 wt % Si, 17.3 wt % Ni, 0.02 wt % C, 0.01 wt % N, 0.02 wt % Zr and 0.2 wt % Hf.

12. The alloy according to claim 1, which consists essentially of 20.1 wt % Cr, 6.5 wt % Si, 19.7 wt % Ni, 0.02 wt % C, 0.01 wt % N, 0.1 wt % Ti and 0.1 wt % Nb.

13. The alloy according to claim 1, which consists essentially of 18.2 wt % Cr, 3.0 wt % Si, 14.0 wt % Ni, 0.01 wt % C, 0.01 wt % N and 0.4 wt % Ta.

14. The alloy according to claim 2, which consists essentially of 18.5 wt % Cr, 4.5 wt % Si, 15.0 wt % Ni, 0.01 wt % C, 0.01 wt % N, 0.1 wt % Ti and 1.0 wt % Mn.

15. The alloy according to claim 2, which consists essentially of 18.4 wt % Cr, 4.6 wt % Si, 15.2 wt % Ni, 0.01 wt % C, 0.01 wt % N, 0.2 wt % Ti and 2.2 wt % Mn.

16. The alloy according to claim 2, which consists essentially of 18.3 wt % Cr, 4.4 wt % Si, 15.0 wt % Ni, 0.01 wt % C, 0.01 wt % N, 0.05 wt % Ti, 1.0 wt % Mn and 0.4 wt % Cu.

17. The alloy according to claim 2, which consists essentially of 18.4 wt % Cr, 4.5 wt % Si, 14.1 wt % Ni, 0.02 wt % C, 0.01 wt % N, 4.1 wt % Mn, 0.8 wt % Cu and 0.3 wt % Nb.

18. The alloy according to claim 2, which consists essentially of 18.0 wt % Cr, 4.2 wt % Si, 16.8 wt % Ni, 0.02 wt % C, 0.02 wt % N, 1.2 wt % Mo, 0.1 wt % Ti and 0.2 wt % Nb.

19. The alloy according to claim 2, which consists essentially of 16.3 wt % Cr, 4.2 wt % Si, 18.5 wt % Ni, 0.02 wt % C, 0.02 wt % N, 2.7 wt % Mo, 0.1 wt % Ti and 0.2 wt % Zr.

20. The alloy according to claim 2, which consists essentially of 17.2 wt % Cr, 3.8 wt % Si, 15.9 wt % Ni, 0.01 wt % C, 0.02 wt % N, 0.9 wt % W and 0.4 wt % Zr.

21. The alloy according to claim 2, which consists essentially of 17.2 wt % Cr, 4.3 wt % Si, 17.9 wt % Ni, 0.01 wt % C, 0.02 wt % N, 2.4 wt % W and 0.2 wt % V.

22. The alloy according to claim 2, which consists essentially of 16.8 wt % Cr, 4.5 wt % Si, 15.3 wt % Ni, 0.01 wt % C, 0.01 wt % N, 1.0 wt % Mn, 1.5 wt % Mo and 0.2 wt % Nb.

23. The alloy according to claim 2, which consists essentially of 17.0 wt % Cr, 4.4 wt % Si, 15.6 wt % Ni, 0.02 wt % C, 0.01 wt % N, 1.0 wt % Mn, 1.0 wt % W and 0.2 wt % Ti.

24. The alloy according to claim 2, which consists essentially of 18.8 wt % Cr, 3.8 wt % Si, 17.2 wt % Ni, 0.02 wt % C, 0.01 wt % N, 1.2 wt % Mn, 0.9 wt % Mo, 1.3 wt % W and 0.2 wt % Ti.

25. The alloy according to claim 2, which consists of 19.2 wt % Cr, 5.0 wt % Si, 19.0 wt % Ni, 0.02 wt % C, 0.02 wt % N, 1.9 wt % Mn, 0.05 wt % Cu, 1.8 wt % Mo, 0.5 wt % W and 0.06 wt % Ti.

* * * * *